US009234360B2

(12) United States Patent
Van Overbeek

(10) Patent No.: US 9,234,360 B2
(45) Date of Patent: Jan. 12, 2016

(54) MOBILE SANITARY UNIT FOR ACCOMMODATING AT LEAST TWO SANITARY FACILITIES

(71) Applicant: Mobile Sanitary Solutions B.V., Oirschot (NL)

(72) Inventor: Petrus Odulphus Joannes Maria Van Overbeek, Oirschot (NL)

(73) Assignee: MOBILE SANITARY SOLUTIONS B.V., Oirschot (NL)

( * ) Notice: Subject to any disclaimer, the term of this patent is extended or adjusted under 35 U.S.C. 154(b) by 49 days.

(21) Appl. No.: 14/358,450

(22) PCT Filed: Nov. 16, 2012

(86) PCT No.: PCT/NL2012/050815

§ 371 (c)(1),
(2) Date: May 15, 2014

(87) PCT Pub. No.: WO2013/095094

PCT Pub. Date: Jun. 27, 2013

(65) Prior Publication Data

US 2014/0325921 A1 Nov. 6, 2014

(30) Foreign Application Priority Data

Nov. 16, 2011 (NL) ..... 2007800

(51) Int. Cl.

| | |
|---|---|
| ***E04H 1/00*** | (2006.01) |
| ***E04H 3/00*** | (2006.01) |
| ***E04H 5/00*** | (2006.01) |
| ***E04H 6/00*** | (2006.01) |

(Continued)

(52) U.S. Cl.

CPC ..... *E04H 1/1216* (2013.01); *E04B 1/343* (2013.01); *E04B 1/344* (2013.01); *E04B 1/3445* (2013.01); *E04B 1/34321* (2013.01); *E04B 2001/34389* (2013.01)

(58) Field of Classification Search

CPC ..... E04B 7/166; E04B 1/343; E04B 1/344; E04B 1/3442; E04B 1/3444; E04B 1/3445; E04B 7/163; E04H 1/1216

USPC ..... 52/79.5, 64, 66, 69, 71

See application file for complete search history.

(56) References Cited

U.S. PATENT DOCUMENTS

| | | | |
|---|---|---|---|
| 4,380,836 | A | 4/1983 | Braxton |
| 4,742,653 | A | 5/1988 | Napier et al. |

(Continued)

FOREIGN PATENT DOCUMENTS

| | | | |
|---|---|---|---|
| BE | 370 543 | A | 5/1930 |
| CN | 102 812 862 | A | 8/2010 |

(Continued)

OTHER PUBLICATIONS

European Patent Office International Search Report for PCT/NL2012/050815 dated Mar. 6, 2013.

*Primary Examiner* — Brian D Mattei

(74) *Attorney, Agent, or Firm* — Shumaker, Loop & Kendrick, LLP

(57) ABSTRACT

A collapsible, mobile sanitary unit for accommodating sanitary facilities such as toilets, showers and washbasins, the unit including a bottom, a circumferential wall, a roof element, and a partition subdividing the interior space into separate compartments, the unit further includes doors for accessing the compartments, and the wall including pivotally connected wall elements arranged to pivot to collapse the unit to reduce the wall height thereof.

11 Claims, 5 Drawing Sheets

(51) Int. Cl.

| | |
|---|---|
| ***E04H 9/00*** | (2006.01) |
| ***E04H 14/00*** | (2006.01) |
| ***E04H 1/12*** | (2006.01) |
| ***E04B 1/343*** | (2006.01) |
| ***E04B 1/344*** | (2006.01) |

(56) References Cited

U.S. PATENT DOCUMENTS

| | | | | |
|---|---|---|---|---|
| 7,828,367 | B2 * | 11/2010 | Hickam et al. | 296/156 |
| 2003/0140573 | A1 * | 7/2003 | Marcinkowski et al. | 52/79.5 |
| 2006/0248809 | A1 * | 11/2006 | Rulquin et al. | 52/79.5 |
| 2010/0024317 | A1 * | 2/2010 | Pope | 52/79.5 |
| 2010/0186309 | A1 * | 7/2010 | Hawkins | 52/79.5 |
| 2010/0287847 | A1 * | 11/2010 | Smith | 52/79.5 |

FOREIGN PATENT DOCUMENTS

| | | | |
|---|---|---|---|
| DE | 27 52 263 | A1 | 2/1979 |
| DE | 102 45 893 | A1 | 4/2004 |
| WO | 2007 012346 | A1 | 2/2007 |

* cited by examiner

MOBILE SANITARY UNIT FOR ACCOMMODATING AT LEAST TWO SANITARY FACILITIES

TECHNICAL FIELD AND BACKGROUND OF THE INVENTION

The invention relates to a mobile sanitary unit for accommodating at least one sanitary facility, such as a toilet.

Such a sanitary unit is commonly known, it is generally used as a temporary sanitary facility, in particular in places where briefly large numbers of sanitary facilities are required, for example at music festivals. The unit comprises a bottom, the circumferential wall that at least partially surrounds the circumference of the bottom, as well as a roof provided on a side of the circumferential wall remote from the bottom. One or more compartments may be provided in the interior of the facility. To that end partitions may be provided, for example. In each compartment a sanitary facility, such as a toilet, is present. Each compartment is accessible to a user via doors provided for that purpose.

The unit is transported, for example from a storage location, to the desired location of use, such as the music festival. After the event in question, the unit is transported back to the storage location.

It is a drawback of the known unit that it takes up relatively much volume. Consequently, the costs of transporting the unit from and to the storage location are relatively high. Furthermore, relatively much storage space is needed for storing the unit at the storage location.

In view of the above problems it has already been proposed to provide units for a sanitary facility with a reducing system for transforming the unit into a reduced state. In said smaller form, the volume taken up by the unit is significantly reduced. WO 2006/029417 A1 thus describes a toilet cabin comprising an upper cabin section and a lower cabin section, which sections are telescopically movable relative to each other. In this way the height can be reduced in the reduced state.

It is a drawback of the known unit comprising a telescopic reducing system that it still takes up relatively much space in its smaller form. In addition to that, moving the unit from the reduced state to a position of use is relatively difficult and time-consuming. The entire upper construction comprising the roof and the side walls, which is relatively heavy, must be lifted. Furthermore it is difficult to effect the connection with the mortise and tenon joint that is used, whilst on the other hand the connection can be undone relatively easily, so that the known unit is not vandal-proof. Another drawback is the fact that door panels are used, so that the known unit comprises relatively many parts.

BRIEF SUMMARY OF THE INVENTION

Accordingly it is an object of the present invention to provide an improved unit for several sanitary facilities, such as a toilet and/or a shower, which can be moved to the position of use in a relatively simple manner and which can subsequently be returned to the reduced state in a relatively simple manner again. Another object of the present invention is to further reduce the volume of the unit in the reduced state, so that a larger transport capacity can be obtained.

In order to achieve that object, the invention provides a mobile sanitary unit as defined in claim 1. According to the invention, the wall part comprises at least two substantially rectangular wall elements, which are disposed one above the other, seen in a direction from the bottom to the roof element. At least one of the wall elements is pivotable about a pivot axis that extends parallel to the plane formed by the bottom. The pivotable wall element makes it possible to reduce the height of the wall part in a simple manner. In the reduced state, the wall elements are already interconnected. As a result, the individual wall elements need not be secured, so that there will be a smaller risk of parts of the unit being lost in the reduced state. The pivotable wall element can be readily pivoted from the reduced state to the position of use and subsequently be secured in that position, for example. Since the pivotable wall element is already connected to the other wall element, and is consequently limited as regards the number of degrees of freedom, securing the wall element will be easier in comparison with the prior art. Consequently, the unit can be more easily moved between a position of use and a reduced state. The object of the present invention is thus achieved.

It is furthermore very advantageous if the pivotable wall element is disposed adjacent to the roof element. The unit can thus be moved from the position of use to the reduced state without there being a need for the unit to be displaced and/or tilted. Preferably, the roof wall element is even pivotally connected to the roof element. In this way the roof element is made to form part of the reducing system. Since the roof element is pivotally connected to the pivotable wall element, the assembly of the wall part and the roof element can be moved to the position of use or to the reduced state in a simple and quick manner in one operation.

According to one aspect of the invention, the mobile sanitary units can be stacked together in a reduced state thereof. Quite preferably, corner pillars disposed in the corner points of the bottom are to that end provided, for example in the form of front and rear corner pillars. On said corner pillars a frame of a further mobile sanitary unit according to the present invention can be placed. In the reduced state, the roof element fits exactly between a front corner pillar and a rear corner pillar. The forces and the weight of the upper mobile sanitary unit are transmitted to the bottom via the corner pillars. Consequently, hardly any, if any, forces are exerted on the roof element of the lower mobile sanitary unit, so that said roof element can be of relatively light construction. As a result, each mobile sanitary unit can be erected to the position of use in a simple manner, and the sanitary unit is nevertheless strong enough for transport.

In order to achieve this position between the corner pillars, it is conceivable for the roof element to undergo a translating movement in a direction parallel to the plane formed by the bottom upon movement from the position of use to the reduced state. This can be effected in a simple manner by configuring the two pivotable wall parts to have different heights.

In order to simplify said stacking together, it is conceivable for the corner pillars to be provided with a stacking aid, such as a tapered guide, on which a frame of a further unit can be placed.

Further advantageous embodiments are the subject matter of the dependent claims. A few of these embodiments will be discussed in more detail hereinafter.

In order to further minimise the volume of the unit in the reduced state, the at least one wall part preferably comprises at least three substantially rectangular wall elements which are disposed one on top of the other, seen in the direction from the bottom to the roof element, wherein at least two adjacent interconnected wall elements of the wall part in question are pivotable about pivot axes that extend parallel to the plane formed by the bottom. In this way two adjacent wall elements are pivotally interconnected. This makes it possible to further reduce the height.

To increase the strength of the unit in the reduced state, it is preferable if the at least one wall part comprises a bottom wall element which is disposed adjacent to the bottom and which is substantially fixedly connected thereto. The fixed bottom wall element preferably forms the circumferential wall of the unit in the reduced state. The proportion between the height of the bottom wall element and the height of the wall part in question ranges between ⅕and ⅗, preferably it equals slightly less than about ⅓. This makes it possible to reduce the height of the unit to 20-60%, preferably to about 33%. In case of an unchanged volume in the position of use, this makes it possible to stack a total of three units according to the invention together and store and/or transport them in that position. This makes a considerable difference in transport and storage charges and leads to a gain of time in transport.

The circumferential wall preferably has a rear wall part and two side wall parts disposed opposite each other. It is conceivable in that regard for the front wall part to be substantially made up of the door element. In the case of a single sanitary facility, the door element preferably takes up the entire width and height of the front wall part. In the situation in which the unit comprises two or more sanitary facilities, for example two toilets, each provided in their own compartment part, more door elements will be needed. In that case, too, the door elements may take up substantially the entire width and height of the front wall part. Preferably, all wall parts (rear wall part and side wall parts) comprise a bottom wall element as already described in the foregoing.

It is preferable if the rear wall part comprises the pivotable wall element. In particular when a relatively wide unit is used, it is preferable to provide the relatively long, and thus heavy, rear wall part with the pivoted wall elements, so that the user can pivot them to the position of use in a relatively simple manner.

Such a wide unit is obtained, for example, if the interior space defined by the bottom, the circumferential wall and the roof element is subdivided into a number of compartments. Each compartment may be provided with its own sanitary facility. Preferably, the unit comprises three or more compartments, which are separated from each other and which are each provided with a sanitary facility, such as a toilet. The compartments may be separated by one or more partition elements. When three or more compartments are used, the width of the unit will be essentially larger than the depth of the unit.

To obtain a compact construction, and that in particular in the reduced state, it is preferable if the roof element and the pivotable wall element are disposed substantially parallel to each other in the reduced state of the unit. Even more preferably, also the further pivotable wall element that may be provided is disposed parallel to the roof element and the pivotable wall element in a reduced state. The directions of pivoting of the pivotable wall element and the further pivotable wall element may in that case be opposed to each other. Preferably, the various elements lie with their sides on or near each other in the reduced state.

It is furthermore advantageous if the roof element is disposed parallel to the bottom in a reduced state of the unit. Additionally, also the pivotable wall element and/or the at least one further pivotable wall element that is pivotally connected thereto may be disposed parallel to the bottom in the reduced state.

Also as regards the proportion between the height of the pivotable wall element and the height of the wall parts it obtains that said proportion preferably ranges between ⅕ and ⅗, preferably it equals about ⅓.

The circumferential wall may comprise a further wall part provided with at least two substantially rectangular connectable wall elements which are detachably connected, wherein sides arranged adjacent to each other of the connectable wall elements placed one on top of the other extend substantially parallel to the plane formed by the bottom. In this way a wall part is configured as a pivotable wall provided with the pivotable wall element (or a number of pivotable wall elements), and the further wall part is configured as a connectable wall provided with detachable, connectable wall elements. A combination of pivotable wall elements and connectable wall elements is also conceivable, however.

In particular, it is especially the side wall parts that comprise the connectable wall elements. The side wall parts are relatively small in size and consequently they are relatively light in weight. Connecting said walls together requires relatively little effort, and can be done in a simple and quick manner.

As already mentioned before, the unit is very suitable for use with a number of compartments, preferably three or more compartments. The interior space may be subdivided into at least two compartments by means of at least one partition element extending between the bottom and the roof element. The partition element is preferably detachably connected to the unit.

Quite preferably, the door element is detachably connected to the unit, being accommodable in the interior of the unit in the reduced state of the unit. Preferably, the door can be placed substantially parallel to the bottom in the reduced state. The pivot axis of the door preferably extends parallel to the bottom. The width of the unit at least equals the height of the door in that case. In particular, the door takes up substantially the entire height of the unit. Consequently, the width of the unit is preferably substantially equal to the height of the unit in the position of use. This embodiment is very advantageous, in particular if three or more sanitary compartments are used. The three or more door elements can be simply placed in the interior of the unit in that case.

In one embodiment, the unit comprises at least one connecting means for locking at least one part detachably connected to the unit, such as the detachable wall element, the detachable door element and/or the detachable partition, in place in the interior of the unit in the reduced state of the unit. Placing the detachable part in the interior of the unit saves space. Locking the part in place ensures that nothing can be lost during transport.

The connecting means preferably comprise a first connecting element that is directed toward the interior of the unit, as well as a second connecting element that is connected to the detachable part, such as the detachable wall element, which second connecting element is designed to cooperate with the first connecting element. The two connecting elements can be easily moved together by a user for effecting the connection. Suitable connecting elements are known per se to the skilled person.

It is furthermore preferable if the roof element is disposed near the side of the bottom wall element remote from the bottom in the reduced state of the unit. In this way a very compact construction is obtained in the reduced state.

The unit further relates to an assembly of at least two stacked-together units according to one or more of the preceding claims.

BRIEF DESCRIPTION OF THE DRAWINGS

The invention will now be explained in more detail with reference to an embodiment shown in the appended figures, in which.

DETAILED DESCRIPTION OF THE INVENTION

Figure 1A:
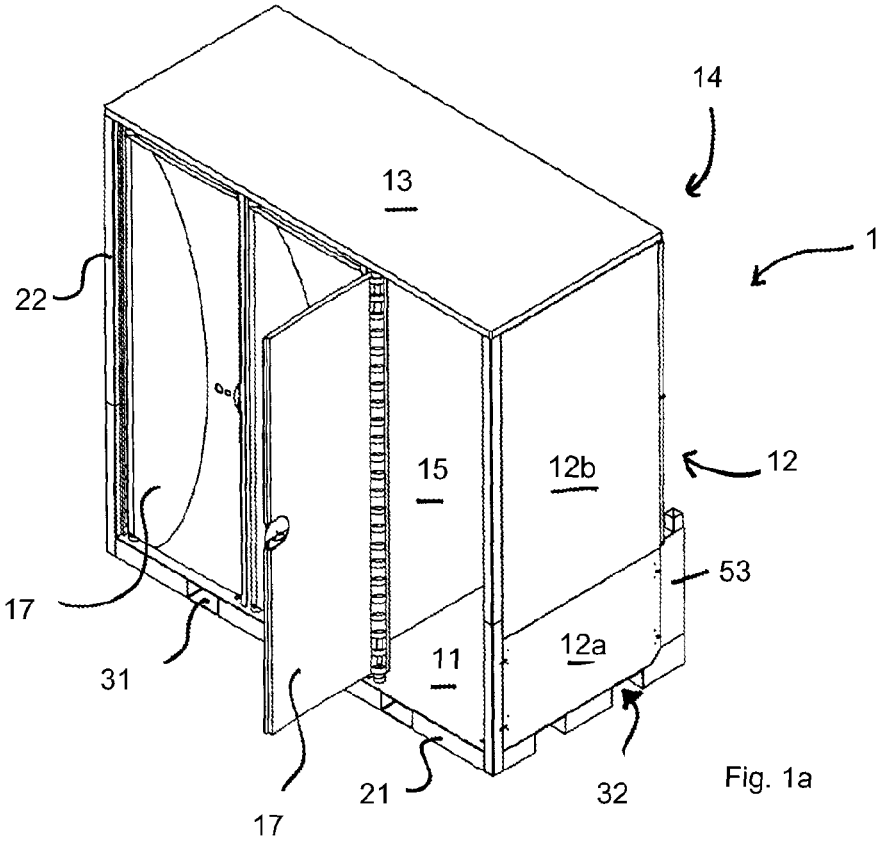
FIG. 1*a* is a perspective view of a mobile sanitary unit according to the present invention.

FIG. 1*a* shows a mobile sanitary unit 1, which is frequently used at locations where a multitude of sanitary facilities are temporarily required. The mobile sanitary unit 1 comprises a bottom 11. Side walls 12 and a rear wall 14 are disposed transversely to the bottom 11. The side walls 12 and the rear wall 14 form a circumferential wall, which partially joins the circumference of the bottom 11. At the front side, the unit is provided with three door elements 17 in total. At the upper side, a roof 13 is provided. The bottom 11, the side walls 12 and the rear wall 14 and also the doors 17 and the roof element 13 define an interior space of the unit 1.

Figure 1B:
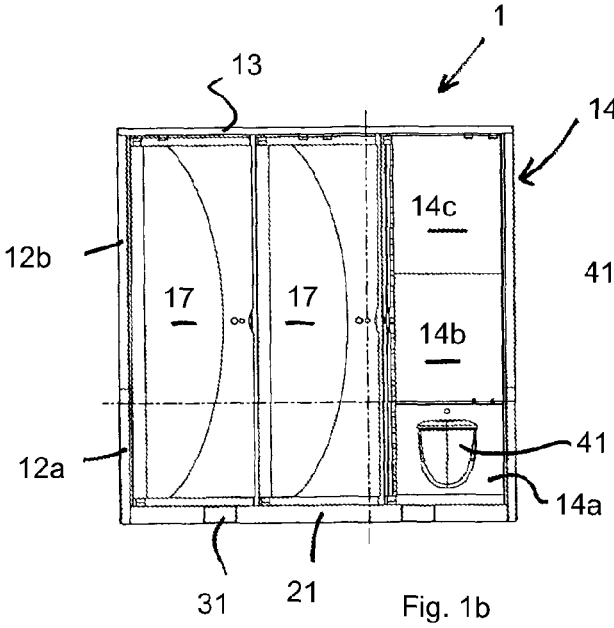
FIG. 1*b* and FIG. 1*c* are a front view and a top plan view, respectively, of the unit of FIG. 1*a;*
Figure 1C:
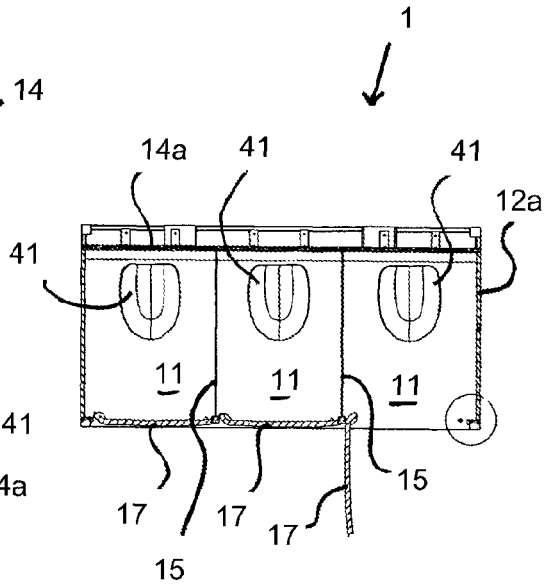

As shown in FIGS. 1*b* and 1*c,* partition elements 15 are disposed behind the door elements 17. The partition elements 15 further divide the interior space of the unit 1 into compartments. In said compartments, a sanitary facility can be placed. Said sanitary facility may be a toilet, a shower and/or a wash-basin, for example. Another facility, or another use of the unit, for example as a box office facility, is also conceivable. In the illustrated embodiment, a toilet 41 is placed in each compartment. It will be understood, however, that also other and/or different sanitary facilities may be provided.

The unit 1 can preferably be modularly connected to further units. Thus, a row of units arranged side by side can be provided at a desired location. The sanitary facilities can preferably be connected to water supply and discharge lines. The sanitary facility is preferably a toilet, even more preferably a vacuum toilet.

The bottom 11 comprises a frame 21 which is provided with recesses 31 on the long side, and with recesses 32 on the short sides. Said recesses perform a function in the transport of the mobile sanitary unit 1. In the illustrated embodiment, the dimensions of the frame 21, in particular the width and the depth, are 1.20×2.40 m. Said dimensions are preferably adapted to the Euro pallet dimensions, which are known per se to the skilled person. The dimensions may be a multiple of said Euro pallet format, for example. The Euro pallet dimensions ensure that transport, for example by means of a truck, and the loading and unloading thereof, for example by means of a forklift truck or a pallet truck, can take place in a simple manner. In specific situations an adaptation to other standardised dimensions, for example of pallets, is conceivable.

As shown in FIG. 1 a and FIG. 1*b,* the side walls 12 and the rear wall 14 are each built up of a number of wall elements or panels 12*a*-12*b* and 14*a*-14*c,* respectively. In the illustrated embodiment, the rear wall 14 is built up of three wall elements 14*a*-14*c* in total, and the side walls 12 are each built up of two wall elements 12*a*-12*b* in total, although it is conceivable to use a different number of wall elements. The lower wall elements 12*a* and 14*a* disposed adjacent to the bottom 11 are preferably fixedly connected to the bottom 11. The wall elements 12*b* and 14*b*-14*c* disposed thereabove are connected to the unit 1 in such a manner as to be movable with respect to the respective lower wall elements 12*a* and 14*a,* as will be explained in more detail with reference to FIG. 2.

Figure 2:
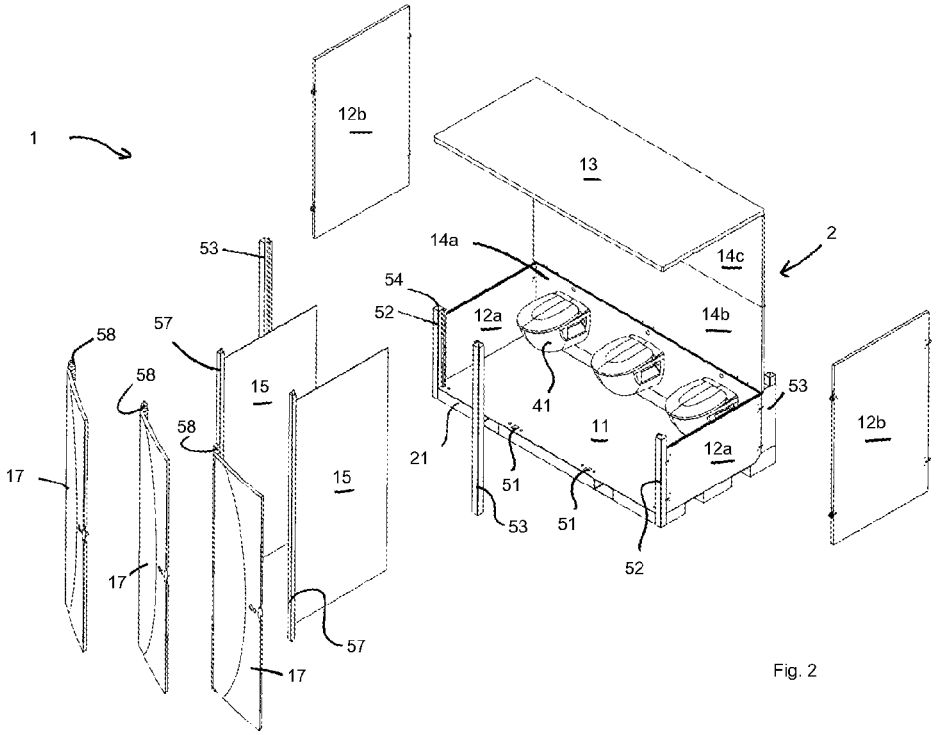
FIG. 2 is an exploded view of the unit of FIG. 1*a;*

FIG. 2 shows an overview of the unit 1 in a disassembled condition. As the figure shows, the wall elements 12*b* of the side wall 12 can be detached from the unit 1. The wall elements 12*a* and 12*b* thus form connectable wall elements that can be connected together in that they can be placed one on top of the other. The wall elements are connected to corner pillars 52, 53. The doors 17 and the partitions 15 are detachable elements as well and can thus be detachably connected to the unit 1. As is shown in FIG. 2, mounting openings 51 are present in the bottom 11 and in the roof 13 (not shown), which mounting openings form part of connecting means. The mounting openings form a first connecting element which is designed to cooperate with second connecting elements 58 on the doors 17 and/or the partitions 15. The mounting openings 51 and the second connecting elements 58 enable easy placement of the doors 17 and the partitions in the unit 1 in the position of use thereof. Connecting means that are known per se to the skilled person may be used for that purpose.

The upper parts 53 of the front corner pillars can furthermore be detached from the lower corner pillars 52. Also in this case connecting means that are known per se can be used.

In the detached condition there is a base unit 2 and a number of separate parts as described above. The base unit 2 comprises a frame 21 and the bottom 11, and a number of bottom wall elements 12*a,* 14*a* connected thereto. The height of the bottom wall elements 12*a,* 14*a* determines in particular the height of the unit in the reduced state. In the illustrated embodiment, the base unit 2 also comprises the sanitary facilities 41. The height of the bottom wall element 12*a,* 14*a* has been selected so that the sanitary facility, and in particular the toilet 41, do not extend above the upper part of the bottom wall elements 12*a,* 14*a*. In this way the toilet 41 can also remain connected to the unit during transport. It is of course conceivable for the sanitary facilities 41 to be detachable from the base unit 2.

Figure 3A:
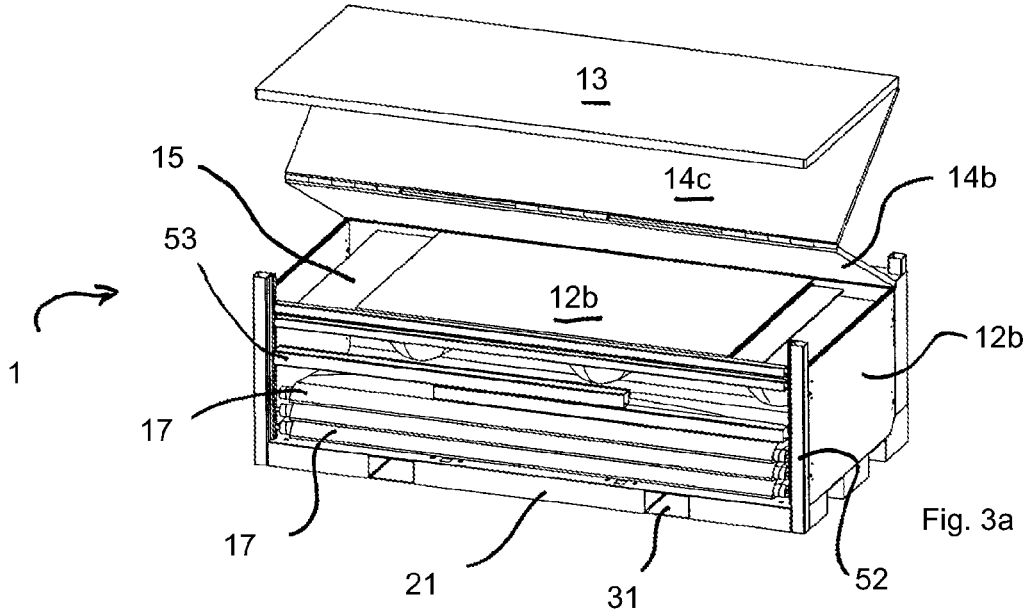
FIGS. 3*a* and 3*b* are a perspective view and a side view, respectively, of the unit in a partially collapsed condition.
Figure 3B:
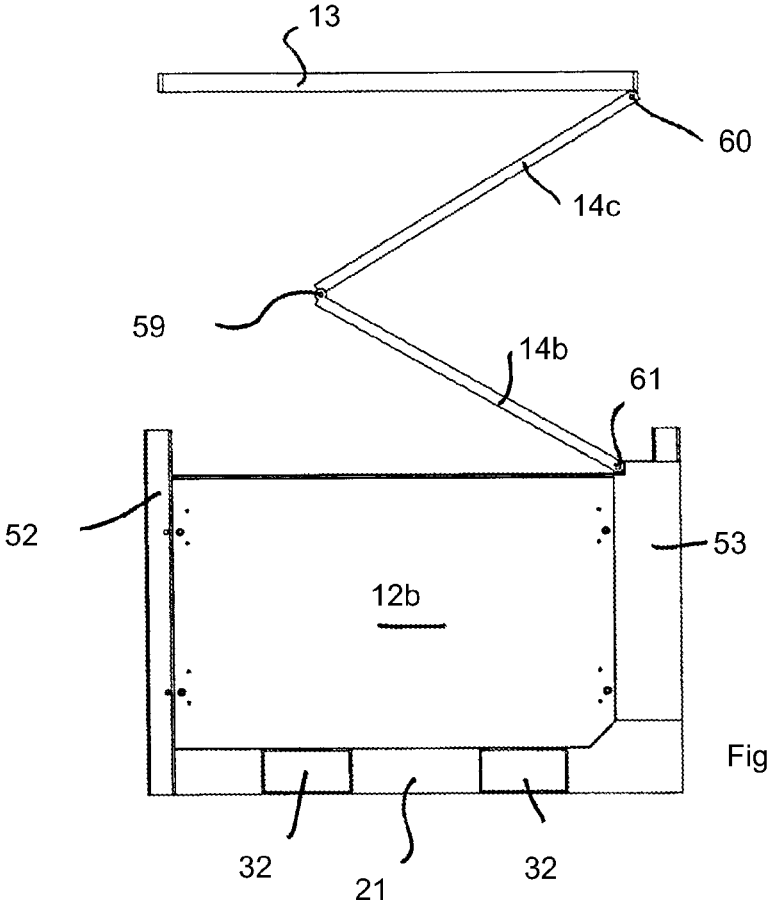

The rear wall panel 14*a* is further connected to a central panel 14*b,* an upper panel 14*c* and the roof part 13 that is connected thereto. The upper panel 14*c* forms a roof wall element 14*c,* which is pivotally connected to the roof element 13. As shown in FIG. 3*a* and FIG. 3*b,* the base unit 2 of the sanitary unit 1 can be moved to a collapsed or reduced state, in which condition the unit takes up significantly less space. The collapsed or reduced state can be effected in a simple and user-friendly manner in that hinge elements 59-61 are provided between each of the rear wall panel 14*a,* the central panel 14*b,* the upper panel 14*c* and the roof part 13 that is connected thereto. As a result, both the central panel 14*b* and the upper panel 14*c* become pivotable wall elements. The pivot axes of the hinge elements 59-61 extend parallel to the plane formed by the bottom 11. Upon movement of the unit to the reduced state, the central panel 14*b* pivots in the opposite direction as the upper panel 14*c.* The roof element 13, too, is a pivotable element; it is capable of movement parallel to the bottom toward said bottom. Also in this case the hinge axis 60 is disposed parallel to the plane formed by the bottom 11. It is noted, incidentally, that in the situation shown in FIG. 3*b,* but also in the situation shown in FIG. 2, the roof part 13 is also pivotable relative to the bottom. This means that the bottom can also be slightly lifted from the situation shown in FIG. 2, such that detachment (or attachment) of the intermediate pillars 53 can take place in a relatively simple manner.

As is shown in FIG. 3*b*, the central panel has a length smaller than that of the upper panel 14*c*. Because of this difference in length, the roof element 13 will move slightly toward the rear upon movement from the unfolded condition to do collapsed condition, such that the roof element 13 will fit exactly between the corner pillars 52, 53 and the stacking aid 55 (see FIG. 4*d*). The stacking aid may be a tapered guide. The corner pillar and/or the stacking aid extend slightly above the roof element 13 in the reduced state, as shown in FIG. 4*d*, so that the forces that occur upon stacking will be transmitted to the corner pillars rather than to the individual wall elements and/or the roof element.

Figure 4A:
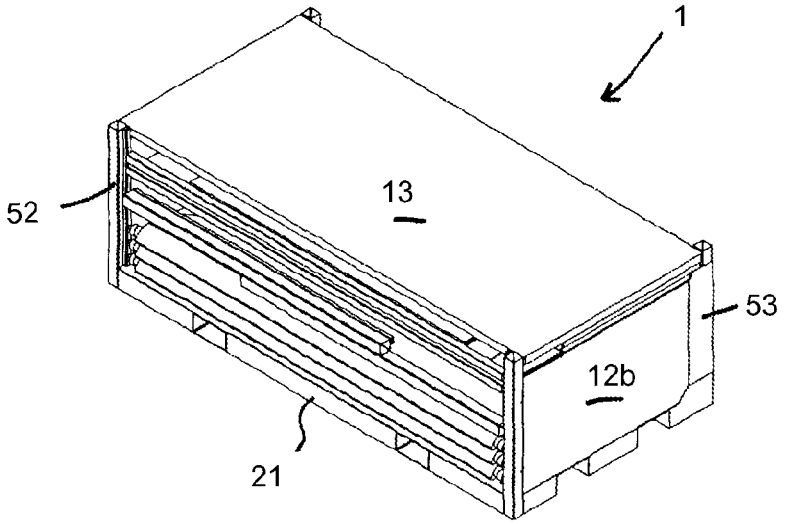
FIG. 4*a* is a perspective view of the unit in a collapsed condition.
Figure 4B:
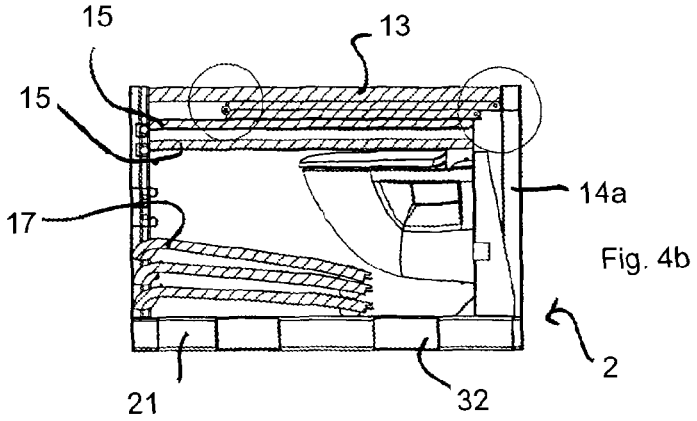
FIG. 4*b* is a sectional view of the unit of FIG. 4*a* in the collapsed condition.

FIG. 4*a* shows the sanitary unit 1 in the collapsed or reduced state. FIG. 4*b* shows a cross-section of the unit 1. In the figure it is clearly discernible that the various detachable parts, such as the doors 17 and the partitions 15, can be accommodated in the base unit 2 also in the collapsed condition. The width of the unit is adapted to the height of the unit, such that sufficient space is available for placing the doors in the transverse direction. When such a width is used, it is very advantageous and space-efficient to provide three compartments in total, which compartments are separated from each other by the partition element 15. If three compartments are used, the dimensions of the unit will be such that all the detachable parts can be accommodated in the interior. The doors, and preferably also the other detachable parts, are locked in place. Means of attachment are to that end again provided in side elements, such as, preferably, in the corner pillar 52. Also the toilet bowl 41 is located in the interior of the base unit 2. Furthermore, also the partitions 15 can be placed in the base unit 2. As a result of the pivoting action of the pivotable wall elements 14*b*-14*c* of the rear wall 14, the rear wall panels 14*b* and 14*c* are automatically received in the interior of the base unit 2, where they are covered by the roof 13.

As is shown in FIG. 4*a*, the front side of the unit 1 is open in the collapsed condition. This is not disadvantageous, however, since the various detachable parts are attached to the base unit in that condition, and consequently cannot become detached against the user's will.

Figure 4C:
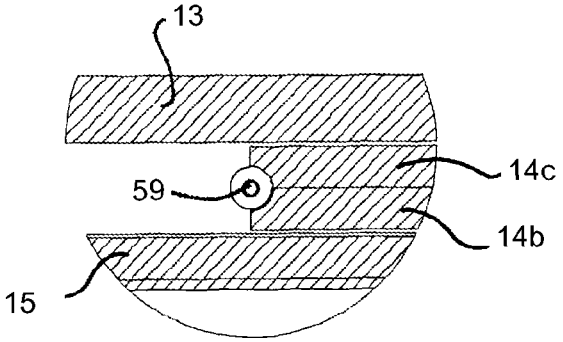
FIG. 4*c* is a detail view of FIG. 4*b;*
Figure 4D:
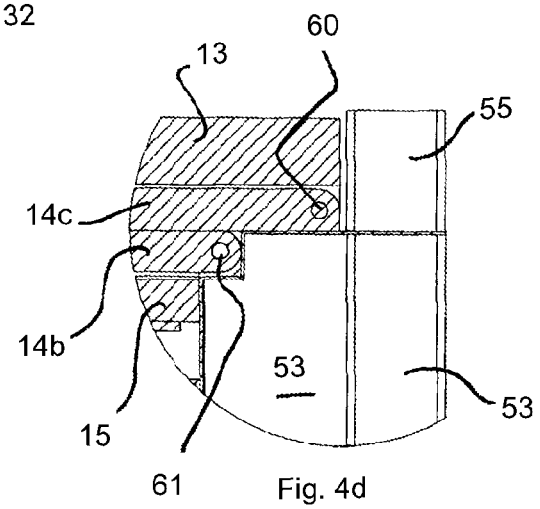
FIG. 4*d* is a detail view of FIG. 4*b;*

FIGS. 4*b*-4*c* are detail views showing the placement of the rear wall panels 14*b*, 14*c* and the roof 13. As the figures show, the pivotable wall elements or panels 14*b* and 14*c* are partially supported on a stop formed by the upper part of a rear pillar 53. The partition 15 extends substantially horizontally between the rear wall 14*a* and the front pillar 52 and is also connected to the two elements. In the connected condition, the partition 15 is supported in such a manner that the rear wall panels 14*b* and 14*c* are in large part supported by said upper partition 15. As already described before, the roof element 13 fits exactly between the front corner pillar 52 and the rear corner pillar 53. A stacking aid 55 is provided on the corner pillar 53, making it possible to stack a number of units together in a simple manner.

Figure 5:
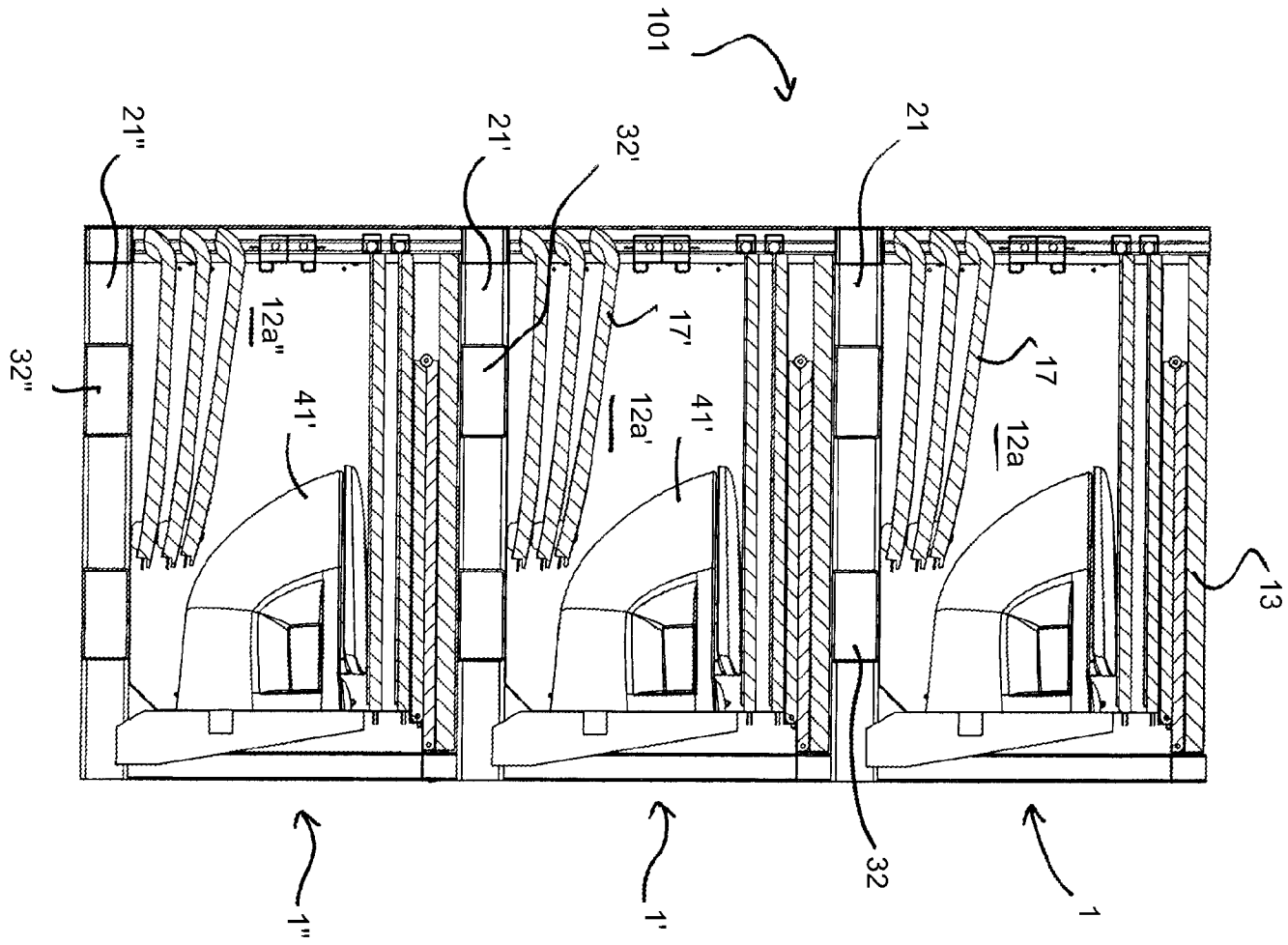
FIG. 5 is a sectional view of an assembly of stacked-together units.

FIG. 5, to conclude, shows an assembly 101 of a few stacked-together units 1, 1', 1". The compactness of the whole in the reduced state is clearly discernible. On the corner pillars 52, 53 (see also FIG. 4*a*) and the stacking aid 55, a frame of a further unit can be placed. In this way several units can be stacked together, so that an assembly of stacked-together units is thus obtained.

The construction of the base unit provided with collapsible rear wall panels makes it possible to realise a major height reduction in a collapsed condition. The height reduction may amount to a factor of three in the specific embodiment that is shown. Since the units can be stacked together, three times as many units in total can be transported in one go in comparison with a non-collapsible unit whilst the transport volume remains the same. After all, if three units are stacked together, said units will take up the same amount of space as one non-collapsible sanitary unit. The stacked units can be readily placed in a standard cargo hold of a truck. Because of the reduction in height, a larger number of units can be transported in a single run, thus saving time and money.

Those skilled in the art will appreciate that the present invention has been described in the foregoing with reference to an embodiment that is preferred. The invention is not limited to this embodiment, however.

Equivalent variants and/or variants which may or may not be obvious to the skilled person are conceivable within the framework of the invention. Said variations fall within the claimed scope as defined in the appended claims.

The invention claimed is:

1. A mobile sanitary unit for accommodating at least two sanitary facilities, comprising:

a bottom;

a circumferential wall at least partially surrounding a circumference of the bottom;

a roof element provided on the circumferential wall spaced from the bottom, wherein interior space cooperatively defined by the bottom, the circumferential wall and the roof element is subdivided by at least one partition extending from the bottom to the roof element to define at least two compartments for separately housing the at least two sanitary facilities, the at least two sanitary facilities being directly laterally adjacent to one another and each sanitary facility having a toilet and a door extending between the bottom and the roof element for accessing each sanitary facility, wherein each toilet is directly laterally adjacent to the partition;

wherein the circumferential wall comprises a reducing system for reducing a distance between the bottom and the roof element to achieve use and reduced states of the mobile sanitary unit, the reducing system including at least two wall elements pivotally connected and arranged vertically one above the other, wherein one of the wall elements pivots about a pivot axis that extends parallel to a plane formed by the bottom;

wherein at least two portions of the circumferential wall and the partition are detachable and are configured for stowing between the toilets and roof element of the sanitary unit when the mobile sanitary unit is in the reduced state;

wherein the doors are configured for stowing directly underneath the toilets when the mobile sanitary unit is in the reduced state; and wherein the roof element is configured to form a cover fitting between front and rear pillars that is parallel to each toilet top when the mobile sanitary unit is in the reduced state.

2. The mobile sanitary unit of claim 1, wherein the bottom is substantially rectangular.

3. The mobile sanitary unit of claim 1, wherein one of the wall elements is pivotally connected to the roof element.

4. The mobile sanitary unit of claim 1, wherein the roof element is configured to translate parallel to the plane formed by the bottom to achieve the use and reduced states of the mobile sanitary unit.

5. The mobile sanitary unit of claim 1, wherein the reducing system comprises at least three interconnected rectangular wall elements, and wherein adjacent interconnected wall elements pivot about a pivot axis extending parallel to the plane formed by the bottom.

6. The mobile sanitary unit of claim 1, wherein one of the at least two wall elements is fixed to the bottom, and wherein a ratio of a height of the wall unit fixed to the bottom to a total wall height is ranges from ⅕ to ⅗.

7. The mobile sanitary unit of claim 1, wherein the circumferential wall comprises a rear wall and two opposing side walls.

8. The mobile sanitary unit of claim 7, wherein the rear wall comprises the reducing system.

9. The mobile sanitary unit of claim 1, wherein the roof element and at least one of the two wall elements are parallel when the mobile sanitary unit is in the reduced state.

10. The mobile sanitary unit of claim 1, wherein the roof element, the bottom, and at least one of the two wall elements are parallel when the mobile sanitary unit is in the reduced state.

11. The mobile sanitary unit of claim 1, wherein the at least one door is detachable and stores within the mobile sanitary unit in the reduced state.

* * * * *